US012338826B2

(12) United States Patent
Elnar

(10) Patent No.: US 12,338,826 B2
(45) Date of Patent: Jun. 24, 2025

(54) UNIVERSAL SPA PUMP

(71) Applicant: Mirna Elnar, Riverside, CA (US)

(72) Inventor: Joseph G. Elnar, Riverside, CA (US)

( * ) Notice: Subject to any disclaimer, the term of this patent is extended or adjusted under 35 U.S.C. 154(b) by 5 days.

(21) Appl. No.: 18/110,556

(22) Filed: Feb. 16, 2023

(65) Prior Publication Data

US 2023/0265852 A1 Aug. 24, 2023

Related U.S. Application Data

(60) Provisional application No. 63/313,014, filed on Feb. 23, 2022.

(51) Int. Cl.
*F04D 13/06* (2006.01)
*F04D 29/42* (2006.01)
*F04D 29/62* (2006.01)

(52) U.S. Cl.
CPC ..... *F04D 13/06* (2013.01); *F04D 29/426* (2013.01); *F04D 29/628* (2013.01)

(58) Field of Classification Search
CPC ..... F04D 13/06; F04D 29/60; F04D 29/628; F04D 29/426; F04C 2230/604; F04B 53/22; H02K 5/00; H02K 5/26; H02K 2215/00
See application file for complete search history.

(56) References Cited

U.S. PATENT DOCUMENTS 1,118,739 A * 11/1914 Carter ..... F04D 29/628 415/126
2,844,100 A * 7/1958 Heinicke ..... F04D 29/426 415/214.1
3,411,450 A * 11/1968 Clifton ..... F04D 13/024 310/104
3,787,014 A * 1/1974 Story ..... H02K 5/00 310/91
3,870,908 A * 3/1975 Button ..... F04B 53/00 310/91
3,903,443 A * 9/1975 Carlson ..... H02K 5/00 411/401
4,019,704 A * 4/1977 Levine ..... H02K 5/00 248/230.9
D244,750 S * 6/1977 Roberts ..... D15/7
4,826,401 A * 5/1989 Clark ..... F04D 29/026 415/206
5,172,754 A * 12/1992 Graber ..... F24V 40/10 165/47

(Continued)

FOREIGN PATENT DOCUMENTS

DE 102005058274 A1 * 6/2007 ..... F04D 13/021
EP 2343793 A1 * 7/2011 ..... H02K 23/64
WO WO-9614218 A2 * 5/1996 ..... A01B 33/028

*Primary Examiner* — Thomas Fink
(74) *Attorney, Agent, or Firm* — AGK Patent & Trademark Law; Philip Y Kim

(57) ABSTRACT

A Universal Spa Pump (USP) allows a user to change the orientation of the pump discharge by redesigning a pump backplate to attach to an electric motor (both 48-frame and 56-frame) separately from the connections between the pump frontplate and a volute. To change the discharge orientation on the USP, the bolts attaching the frontplate (or volute) to the backplate are removed, the frontplate rotated, and the bolts reattached. By maintaining the connection between the pump backplate, the motor, a motor shaft, shaft seal, the alignment of the backplate and the impeller is maintained.

2 Claims, 4 Drawing Sheets

(56) References Cited

U.S. PATENT DOCUMENTS

| | | | | | |
|---|---|---|---|---|---|
| 5,676,805 | A * | 10/1997 | Silveri | C02F 1/4602 | 204/216 |
| 6,036,452 | A * | 3/2000 | Huang | F04D 13/021 | 403/337 |
| 2018/0119443 | A1* | 5/2018 | Panzella | F04B 1/0448 | |
| 2020/0032814 | A1* | 1/2020 | Huang | F04D 29/628 | |
| 2021/0123455 | A1* | 4/2021 | Lee | F04D 13/021 | |

* cited by examiner

UNIVERSAL SPA PUMP

CROSS-REFERENCE TO RELATED APPLICATIONS

The present application claims the priority of U.S. Provisional Patent Application Ser. No. 63/313,014 filed Feb. 23, 2022, which application is incorporated in its entirety herein by reference.

BACKGROUND OF THE INVENTION

The present invention relates to pumps and to spa pumps in particular.

Spa pumps generally include six parts, a pump body, a watercut, a volute, an impeller, a shaft seal, and an electric motor. The volute and intake are on the frontplate of the pump body and the discharge and watercut are in the backplate of the pump body. Traditionally, a pump backplate and faceplate (together making up the pump body) are connected by bolts that pass through the pump body and the electric motor.

The standard orientation of the pump body is either the discharge is vertically up, to the right (90 degrees), or to the left (−90 degrees). Some pumps have the discharge at a 45 degree angle. To set the discharge orientation, four assembly bolts connecting the pump body to the motor have to be removed so that the pump body could be rotated to the desired orientation when assembled. The pump backplate and the impeller must be properly aligned to maintain the impeller's proper concentricity. The plumbing/tubing within the hot tub must then be positioned to match the discharge orientation of the pump. Thus, if in the future the pump is replaced, the hot tub owner is limited to purchasing from manufacturers that offer the exact discharge orientation that matches their hot tub plumbing and the original pump.

Proper functioning of the pump is dependent upon the correct orientation of the main parts. The rotation of the impeller by the electric motor creates a suction force through the inlet of the frontplate, which pulls water into the frontplate by centrifugal force. The velocity of the water increases while it is inside of the pump body, specifically while it is in the narrowest part of the volute. As the water travels through the curves of the volute, the increase in area also allows for an increase in water pressure. Then the watercut, is traditionally located in the backplate, cuts the high-pressure water's rotational flow and directs the water flow toward the discharge. Thus, the volute, discharge, and watercut must be aligned correctly in respect to one another to allow for maximum efficiency and discharge of water through the pump. Failure to do so will result in a plethora of issues. Additionally, the impeller and shaft seal must be aligned correctly to maintain concentricity within the pump and prevent misalignment of the impeller and water leakage. As a result, Modifications to pumps are highly unlikely to be successful if done outside of the manufacture/without proper equipment.

Therefore, assembly of traditional spa pumps requires careful attention to the orientation of all of the parts. This, in addition to the fact that motor manufacturers do not produce motors with variations regarding the locations of the inserts for the assembly bolts, limits the possible orientations in which pumps could be made. Thus, the standard discharge orientations are vertically up (0 degrees, to the right (90 degrees, or to the left (−90 degrees.) Some manufactures have attempted to capitalize upon this by altering the discharge orientation to other angles, resulting in consumers only being able to purchase replacement pumps from them in the future. However, this orientation also makes it impossible for them to set the discharge location at the traditional/standard positions as well. As a result, these pumps cannot be used to replace pumps with the standard discharge orientations. To date, there is no pump on the market that can be positioned so that the discharge can be set to either the standard positions or the 45 degree position.

BRIEF SUMMARY OF THE INVENTION

The present invention addresses the above and other needs by providing a Universal Spa Pump (USP) which allows a user to change the orientation of the pump body by redesigning a pump backplate to attach the backplate to an electric motor (both 48-frame and 56-frame), and frontplate independently attaching to the backplate. To change the discharge orientation on the USP, the fasteners attaching the frontplate to the backplate are removed, the frontplate rotated, and the fasteners reattached. By maintaining the attachment of the backplate to the motor, shaft seal alignments are properly maintained. Significantly, the inlet, discharge, and volute on the USP are all located on the frontplate of the pump body. This differs from a traditional pump and allows for all parts to remain properly oriented to one another while rotating to alter the discharge orientation.

In accordance with one aspect of the invention, there is provided a universal spa pump. Positioning traditional pumps in various orientations is limited by three factors: assembly bolts positioning on the motor, proper alignment of the various components, and maintaining concentricity of the motor shaft, impeller, and shaft seal within the backplate. The USP resolves this issue by repositioning the discharge and watercut so that instead of being located on the backplate, they are on the frontplate of the pump body. The simple backplate is bolted to the electric motor at, for example, four standard positions, but the frontplate is not directly attached to the motor. Instead, the frontplate is bolted to the backplate separately. This allows the frontplate to be rotated so that the discharge can be placed at any position and all of the components (volute, watercut, inlet, and discharge) of the pump body will still be correctly aligned and mounted onto the motor properly since they are all located on the frontplate. Thus, to change the discharge orientation of the USP, the bolts attaching the frontplate to the backplate are removed, the frontplate is rotated, and the bolts are reattached. Since the connection between the backplate and the electric motor is not altered, the concentricity of the motor shaft, shaft seal, and impeller is never compromised and remains positioned as they were at the time of manufacture. As a result, this pump can be modified onsite by the average consumer without the need to send it back to the manufacturer, and can be used to replace any pump in the spa industry.

In accordance with another aspect of the invention, the USP has also been engineered so that its simple backplate is able to attach to both 48-frame and 56-frame electric motors. If the consumer wishes to change the size of their motor after purchase, they can easily do so without having to replace the entire pump, and they can do it themselves. The USP may include two faceplate designs for different plumbing sizes and the backplate is capable of fitting different types of impellers. These features allow the USP to be used with many different impeller and electric motor combinations, at various discharge positions, while also maintaining maximum pumping efficiency. Significantly, the inlet, discharge, and volute on the USP are all located on the frontplate of the pump body. This differs from a traditional pump and allows for all parts to remain properly oriented to one another while rotating to alter the discharge orientation. Overall, the design and modifications made to this pump make it the first truly universal spa pump on the market.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement, or within 10 percent of a stated value.

Figure 1:
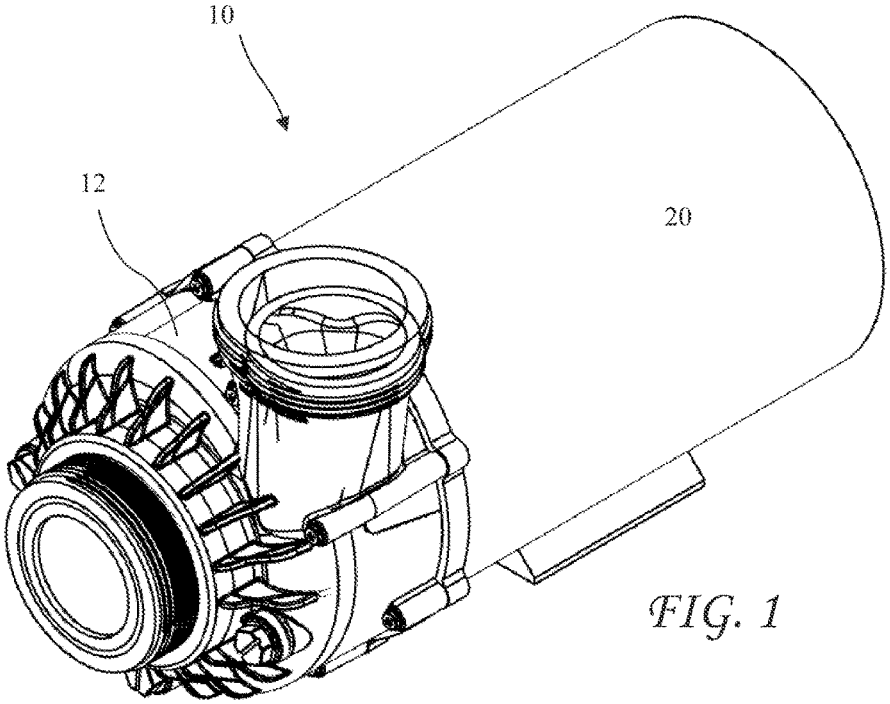
FIG. 1 shows a Universal Spa Pump (USP) according to the present invention.
Figure 2:
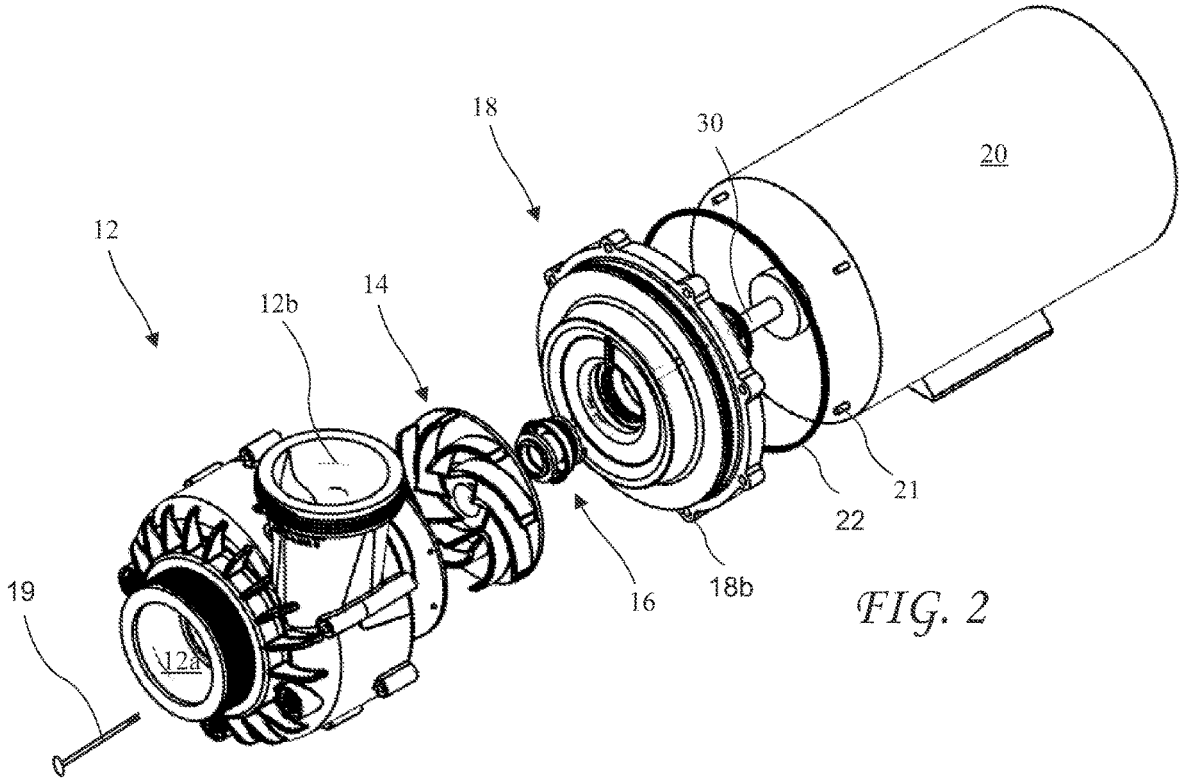
FIG. 2 shows an exploded view of the USP according to the present invention.

An assembled view of a Universal Spa Pump (USP) 10 is shown in FIG. 1 and an exploded view of the USP 10 is shown in FIG. 2. The USP 10 includes five main parts: a frontplate 12, an impeller 14, a shaft seal 16, a backplate 18, and an electric motor 20. The frontplate 12 is attached to the backplate 18 by frontplate fasteners 19. The backplate 18 is separately attached onto the electric motor 20 by motor fasteners 21. A motor shaft 30 passes through shaft seal 16 in the center of the backplate 18. A shaft seal 16 is between a shaft 30 the backplate 18, and a backplate seal 22 is between the backplate 18 and motor 20. The impeller 14 is then positioned onto the motor shaft 30.

Figure 3A:
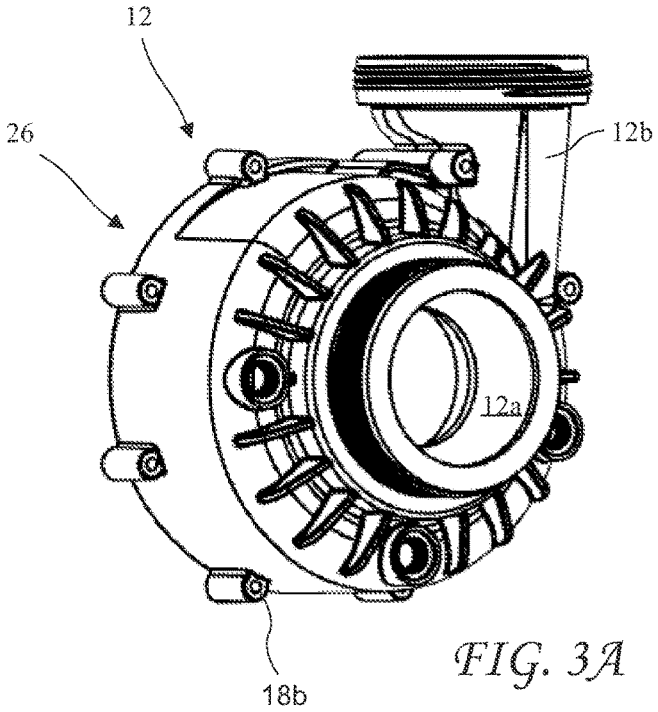
FIG. 3A shows a front and side view of a frontplate of the USP according to the present invention.
Figure 3B:
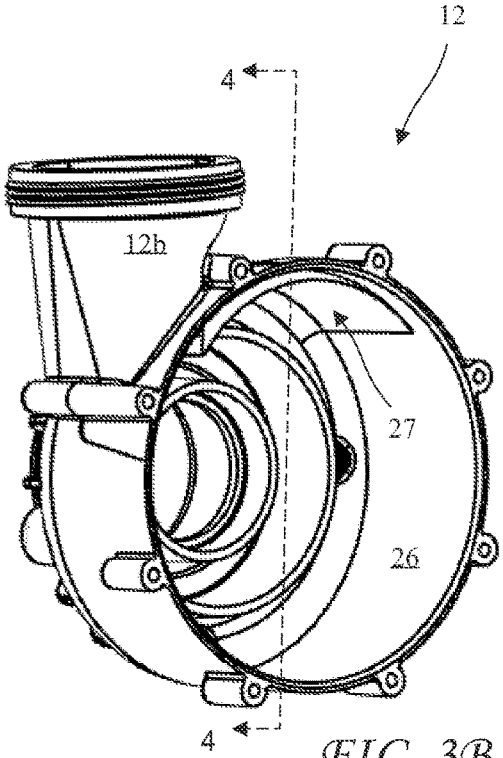
FIG. 3B shows a rear and side view of the frontplate of the USP according to the present invention.
Figure 4:
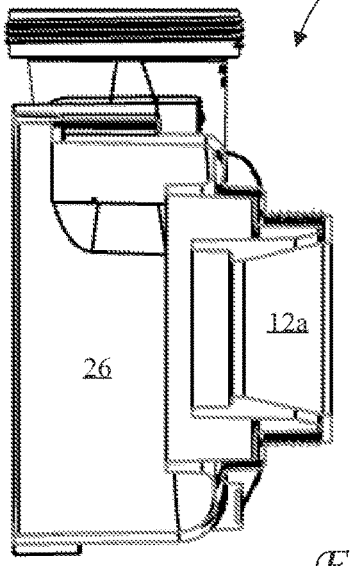
FIG. 4 shows a cross-sectional view of the frontplate of the USP according to the present invention taken along line 4-4 of FIG. 3B.

A front and side view of the frontplate 12 of the USP 10 is shown in FIG. 3A, a rear and side view of the frontplate 12 is shown in FIG. 3B, and a cross-sectional view of the frontplate 12 taken along line 4-4 of FIG. 3B is shown in FIG. 4. The frontplate 12 has a water inlet 12*a* axially located at the front center, a volute 26 inside the frontplate 12, and a water discharge 12*b* comes radially out of the frontplate 12. The volute 26 is inside the frontplate 12 and the impeller 14 spins inside the volute providing a centrifugal pump. Water flows into the water inlet 12*a*, through the volute 26, and out the water discharge 12*b* directed by a watercut 27 inside the volute 26. The water discharge 12*b* is generally directed up, but may be directed to the side.

Figure 5:
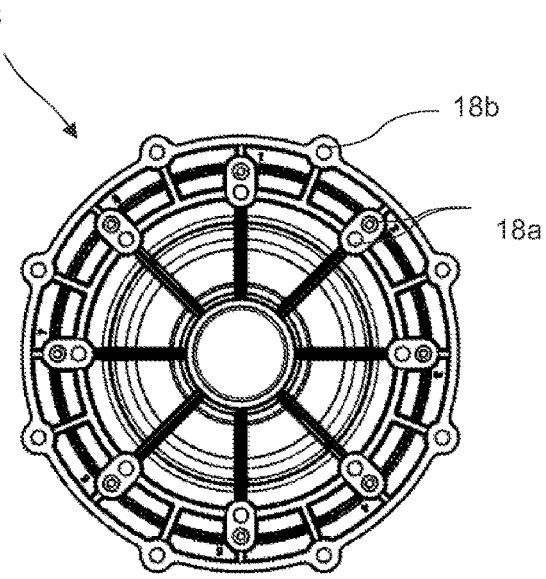
FIG. 5 shows a rear view of a backplate of the USP according to the present invention.

A rear view of the backplate 18 is shown in FIG. 4. The backplate 18 includes pairs of threaded motor attachment passages 18*a* (see FIG. 5) for motor fasteners 21 for either 48-frame and 56-frame motors, and threaded frontplate attachment passages 18*b* for frontplate fasteners 19.

Figure 6:
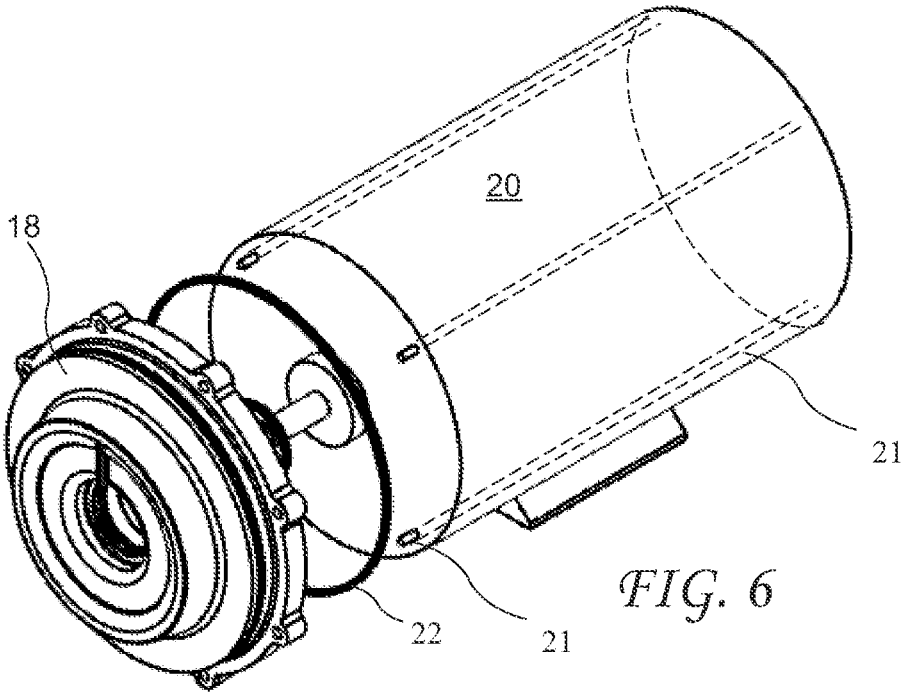
FIG. 6 shows a front and side exploded view of the backplate, motor, and backplate fasteners according to the present invention.
Figure 7:
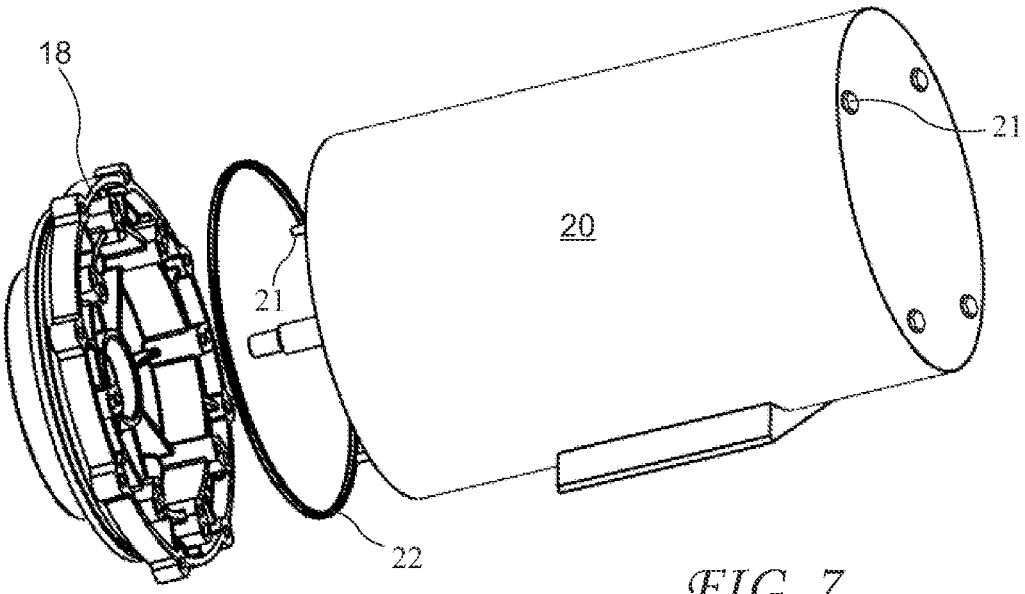
FIG. 7 shows a rear and side exploded view of the backplate, motor, and backplate fasteners according to the present invention.

A front and side exploded view of the backplate 18, motor 20, and motor fasteners 21 is shown in FIG. 6 and a rear and side exploded view of the backplate 18, motor 20, and motor fasteners 21 is shown in FIG. 7. In an example embodiment, four motor fasteners 21 reach the entire length of the motor 20 and into the backplate 18. The motor fasteners 21 do not engage the frontplate 12 or retain the frontplate 12 on the pump 10. Those skilled in the art will recognize other examples where backplate bolts reach through a backplate and into an adjacent surface of the motor to secure the backplate to the motor, or the backplate 18 is held by studs extending from the motor 10, and any pump retaining a backplate to the motor without retaining or engaging the frontplate is intended to come within the scope of the present invention.

Figure 8:
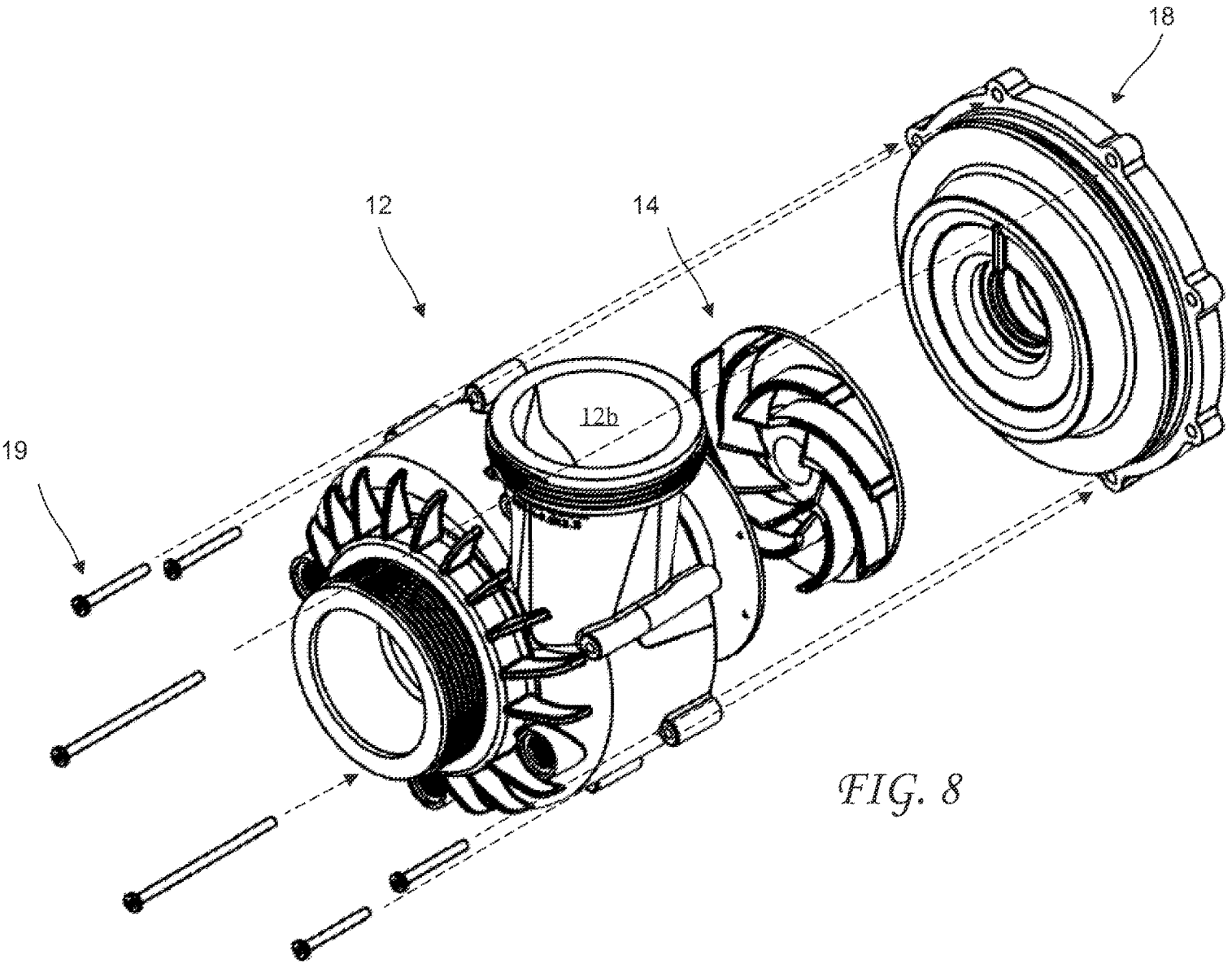
FIG. 8 shows the attachment of the frontplate to the backplate of the USP according to the present invention.

An exploded view of the frontplate 12, impeller 14, and backplate 18 is shown in FIG. 8. In the example shown, eight frontplate fasteners 19 (six shown) retain the frontplate 12 on the backplate 18. The frontplate fasteners 19 do not engage the motor 20 and the frontplate 12 may be detached, rotated, and reattached to the backplate 18 without disturbing the relationship of the backplate 18 to the motor 20. Eight evenly angularly spaced frontplate fasteners 19 allow the frontplate to be rotated in 45 degree steps to reorientate the direction of the water discharge 12*b* for each installation.

While the invention herein disclosed has been described by means of specific embodiments and applications thereof, numerous modifications and variations could be made thereto by those skilled in the art without departing from the scope of the invention set forth in the claims.

I claim:

1. A Universal Spa Pump (USP), comprising:

a 48-frame motor or a 56-frame motor;

a backplate attached to the motor by motor fasteners reaching through the motor an into threaded motor attachment passages in the backplate, the motor fasteners not engaging a frontplate, the threaded motor attachment passages comprising pairs of the threaded motor attachment passages for both the 48-frame motor and the 56-frame motor;

a motor shaft reaching forward from the motor through the backplate;

an impeller riding on the motor shaft ahead of the backplate;

the frontplate residing over impeller and including an inlet, a discharge, and a volute;

a watercut in the volute directing a flow of water to the discharge;

the frontplate attached to the backplate by eight angularly spaced 45 degrees apart frontplate fasteners engaging eight angularly spaced 45 degrees apart threaded frontplate attachment passages in the backplate, the frontplate attachable to the backplate in 45 degree steps to reorientate the direction of the discharge; and the frontplate is detachable from the backplate by removing the frontplate fasteners and leaving the backplate fasteners in place, wherein removal of the frontplate does not detach the backplate from the motor or disturb the relationship of the backplate to the motor shaft or motor.

2. The USP of claim 1, wherein the frontplate is detachable from the backplate and reattachable at a different orientation.

* * * * *